US007979021B2

(12) United States Patent
Yokoyama et al.

(10) Patent No.: US 7,979,021 B2
(45) Date of Patent: Jul. 12, 2011

(54) IMAGE FORMING APPARATUS, SHEET DISCHARGING DEVICE AND METHOD OF CONTROLLING THE SHEET DISCHARGING DEVICE

(75) Inventors: Seiji Yokoyama, Numazu (JP); Atsuhiko Yamaguchi, Izu (JP)

(73) Assignee: Canon Kabushiki Kaisha, Tokyo (JP)

( * ) Notice: Subject to any disclaimer, the term of this patent is extended or adjusted under 35 U.S.C. 154(b) by 622 days.

(21) Appl. No.: 11/671,677

(22) Filed: Feb. 6, 2007

(65) Prior Publication Data

US 2007/0201925 A1 Aug. 30, 2007

(30) Foreign Application Priority Data

Feb. 28, 2006 (JP) ..... 2006-052152

(51) Int. Cl.
*G03G 15/00* (2006.01)

(52) U.S. Cl. ..... 399/410; 399/361; 399/407; 399/408; 270/37; 270/58.08

(58) Field of Classification Search ..... 399/361, 399/362, 363, 381, 407, 408, 410; 270/37, 270/58.08, 58.09
See application file for complete search history.

(56) References Cited

U.S. PATENT DOCUMENTS 5,449,157 A * 9/1995 Kawano et al. ..... 270/58.11
5,542,655 A * 8/1996 Murakami ..... 270/58.09
6,122,464 A * 9/2000 Kakigi ..... 399/82
6,217,016 B1 * 4/2001 Honmochi et al. ..... 270/37
6,674,976 B2 1/2004 Sato et al. ..... 399/18
6,741,817 B2 5/2004 Seto ..... 399/75
2004/0076445 A1 4/2004 Seto
2004/0174552 A1 * 9/2004 Miyake et al. ..... 358/1.12

FOREIGN PATENT DOCUMENTS

EP 0 614 306 9/1994
JP 04128096 A * 4/1992
JP 9-183561 7/1997
JP 11-102095 4/1999
JP 9-255219 9/1999
JP 11-353142 12/1999
JP 2002-268502 9/2002
JP 2005195858 A * 7/2005

OTHER PUBLICATIONS

Official Action, issued by the State Intellectual Property Office of P.R. China, dated Jul. 18, 2008, in Chinese Application No. 207100796355 (Translation).

* cited by examiner

*Primary Examiner* — Daniel J Colilla
*Assistant Examiner* — 'Wyn' Q Ha
(74) *Attorney, Agent, or Firm* — Fitzpatrick, Cella, Harper & Scinto

(57) ABSTRACT

An image forming apparatus, a sheet discharging device and method of controlling the sheet discharging device are disclosed. They require no instructions from users and no recording materials for initial setting of a staple when the users exchange a staple cartridge.

15 Claims, 10 Drawing Sheets

| EXAMPLE OF DISCHARGING RESERVATION COMMAND (2 SHEETS × 2 SETS) | | | INFORMATION FROM STAPLE UNIT |
|---|---|---|---|
| DISCHARGING RESERVATION 1 | HEAD | STAPLE PROCESSING | PROCESSING TIME 1: INITIATION OPERATION OF SHEET DISCHARGING DEVICE |
| DISCHARGING RESERVATION 2 | LAST | STAPLE PROCESSING | PROCESSING TIME 2: TIME NECESSARY FOR LOADING SHEETS ON STAPLE TRAY |
| DISCHARGING RESERVATION 3 | HEAD | STAPLE PROCESSING | PROCESSING TIME 3: TIME NECESSARY FOR INITIAL SETTING (INCLUDING STAPLE PROCESSING TIME) |
| DISCHARGING RESERVATION 4 | LAST | STAPLE PROCESSING | PROCESSING TIME 4: TIME NECESSARY FOR LOADING SHEETS ON STAPLE TRAY |

FIG.8

| EXAMPLE OF DISCHARGING RESERVATION COMMAND (A SET OF 2 STAPLED SHEETS, A BOOKLET OF 2 SHEETS) | | | INFORMATION FROM STAPLE UNIT |
|---|---|---|---|
| DISCHARGING RESERVATION 1 | HEAD | STAPLE PROCESSING | PROCESSING TIME 1: INITIATION OPERATION OF SHEET DISCHARGING DEVICE |
| DISCHARGING RESERVATION 2 | LAST | STAPLE PROCESSING | PROCESSING TIME 2: TIME NECESSARY FOR LOADING SHEETS ON STAPLE TRAY |
| DISCHARGING RESERVATION 3 | HEAD | BOOKLET PROCESSING | PROCESSING TIME 3: TIME NECESSARY FOR SWITCHING TRANSPORTING PATHS |
| DISCHARGING RESERVATION 4 | LAST | BOOKLET PROCESSING | PROCESSING TIME 4: TIME NECESSARY FOR TRANSPORTING SHEETS TO BOOKLET PROCESSING UNIT |

FIG.9

IMAGE FORMING APPARATUS, SHEET DISCHARGING DEVICE AND METHOD OF CONTROLLING THE SHEET DISCHARGING DEVICE

BACKGROUND OF THE INVENTION

1. Field of the Invention

The present invention relates to an image forming apparatus for forming an image on a recording material such as a sheet according to an image forming command given from outside the apparatus and transporting the sheets to a sheet post processing means upon executing post processing. The present invention also relates to a sheet discharging device of the image forming apparatus and method of controlling the sheet discharging device.

2. Description of the Related Art

An image forming apparatus forms an image on a sheet in accordance with an image forming command (signals indicating the printing request contents) from an external apparatus such as a host computer, and then discharges the sheet to a standard discharging port of the image forming apparatus. Conventionally, when handling a large number of sheets, there have been proposed various kinds of methods in which a sheet discharging device having a recording material post-processing means for carrying out the postprocessing of the recording material, e.g., sorting the sheets, staple processing, etc., is connected to the discharge side of the image forming apparatus to be controlled (see Japanese Patent Application Laid-open No. 2002-268502, for example).

However, the sheet discharging device of the above-described structure has the following issues.

The sheet discharging device is provided with a staple unit for performing staple processing, and the staple unit is provided with a staple cartridge for housing staples and a staple detecting sensor for detecting the existence of the staples. Upon detecting that there are no staples within the staple cartridge, the sheet discharging device informs a controller that there are no staples, and displays on an operation panel that the staple cartridge needs to be exchanged. In that case, the user exchanges the staple cartridge, and instructs the image forming apparatus to perform initial setting of the staple cartridge through an operation panel. For example, the initial setting can be an operation which lets out a head of the staple. The operation means operation that exposes the staple tips.

Upon receiving the instruction of the initial setting, the image forming apparatus feeds a recording material to be used for the initial setting, and performs idle striking on the recording material transported to the staple unit of the sheet discharging device to bring out the staple within the staple cartridge to the stapling position. In this way, it has not been conventionally possible to exchange the staple cartridge and perform the initial setting, without an instruction from a user and without needing a recording material for idle striking to perform the staple preparation processing.

SUMMARY OF THE INVENTION

An object of the present invention therefore is to provide an image forming apparatus that is capable of exchanging a staple cartridge and performing the initial setting without an instruction from a user and/or without needing a recording material for the initial setting. For example, the initial setting can be an operation which exposes the staple tips.

According to a first aspect of the present invention, there is provided an image forming apparatus as specified in claims 1 to 7.

According to a second aspect of the present invention, there is provided a sheet discharging device as specified in claims 8-11.

According to a third aspect of the present invention, there is provided a method as specified in claim 12.

The image forming apparatus according to the present invention requires no instruction from the user and no recording material for the initial setting even after exchanging the staple cartridge, and it is possible to perform the initial setting in a regular printing operation.

Further features of the present invention will become apparent from the following description of exemplary embodiments (with reference to the attached drawings).

BRIEF DESCRIPTION OF THE DRAWINGS

FIG. 8 is a table showing sheet discharging reservation commands and processing time information from the sheet discharging device in the case of the first embodiment of the present invention; and FIG. 9 is a table showing sheet discharging reservation commands and processing time information from the sheet discharging device in the case of the second embodiment of the present invention.

DESCRIPTION OF THE EMBODIMENTS

Embodiments of the present invention will be described hereinafter while referring to the accompanying drawings.

First Embodiment

The overall structure of a laser printer of a multicolor image forming apparatus will be described hereinafter as an example of an image forming apparatus according to this embodiment.

Figure 1:
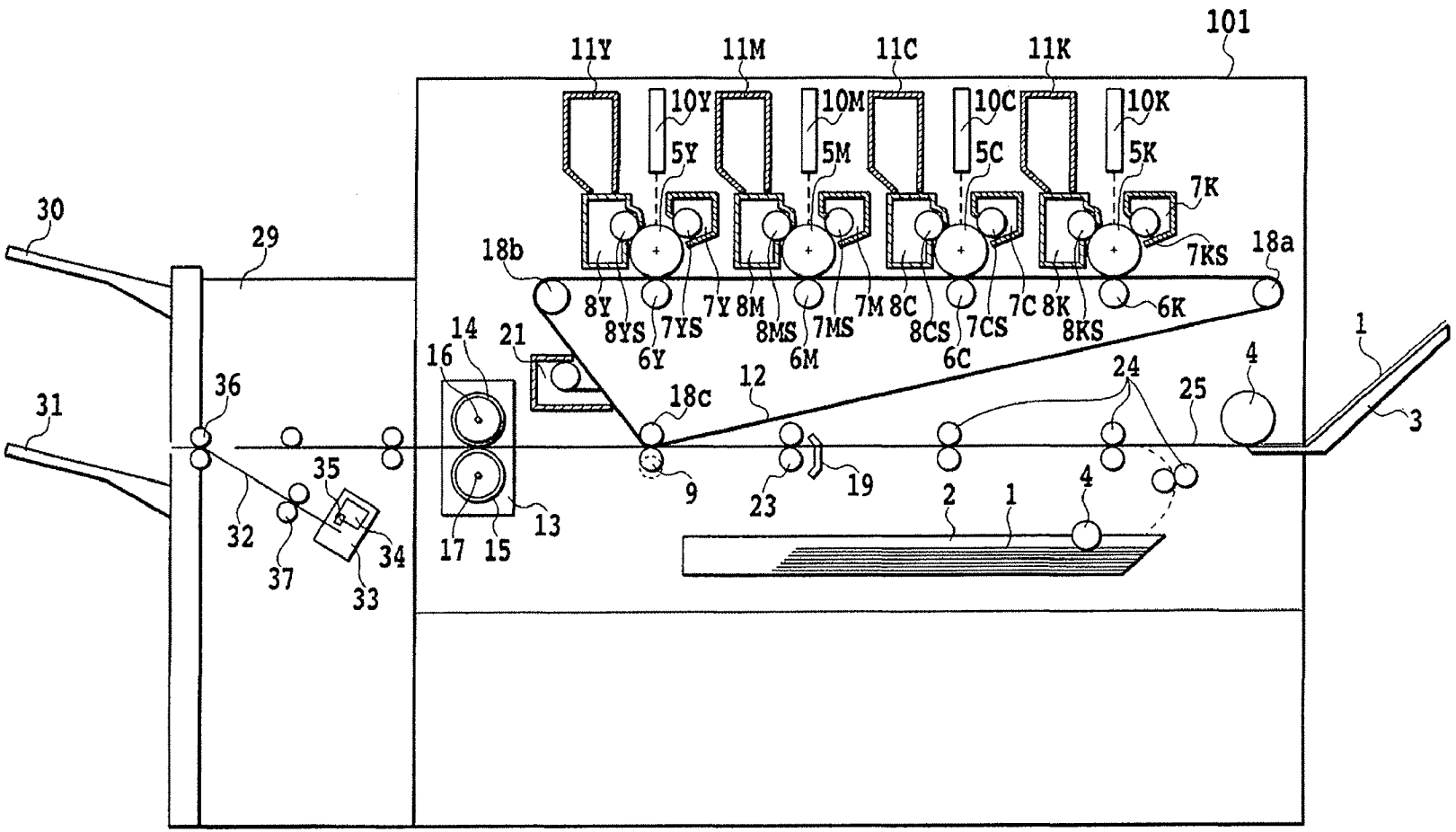
FIG. 1 is a schematic diagram of a color image forming apparatus according to a first embodiment of the present invention.
Figure 2:
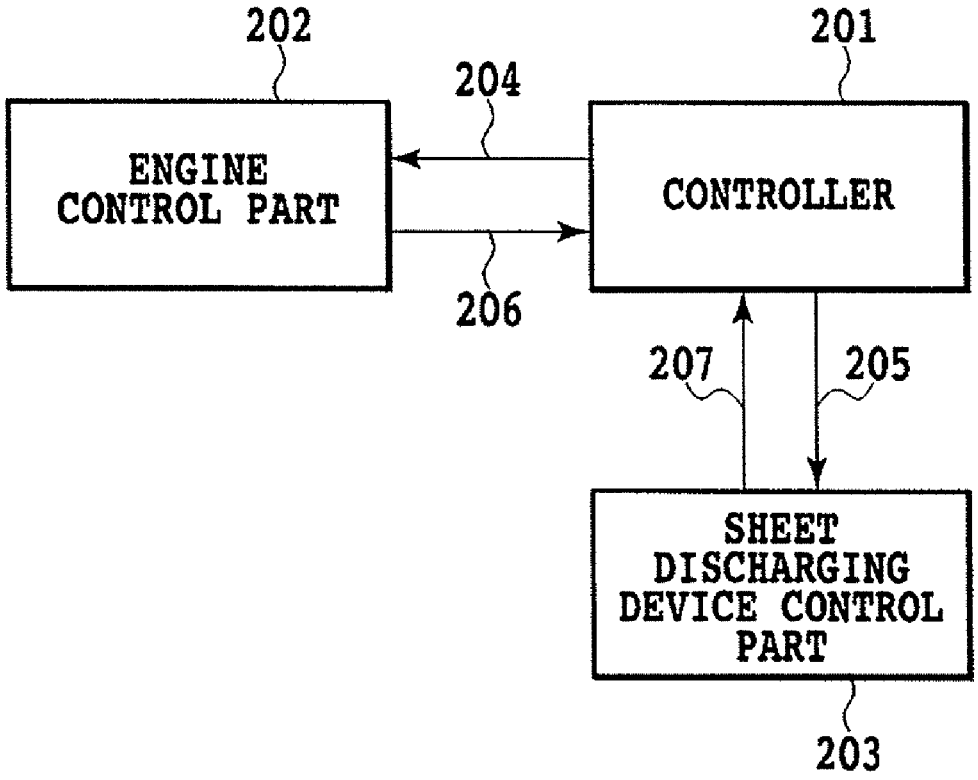
FIG. 2 is an illustration showing the relation of a controller, an engine control part, and a sheet discharging device control part of the color image forming apparatus according to the first embodiment of the present invention.

FIG. 1 is a sectional perspective view showing an image forming apparatus 101 to which a sheet discharging device 29 is mounted, and FIG. 2 is a block diagram showing the system structure of the image forming apparatus.

In FIG. 2, reference numeral 201 denotes a controller, 202 denotes an engine control part, and 203 denotes a sheet discharging device control part. Furthermore, in FIG. 2, 204 denotes a serial command transmission signal line for transmitting a command from the controller 201 to the engine control part 202 through serial communication, and 205 denotes a serial command transmission signal line for transmitting a command from the controller 201 to the sheet discharging device control part 203 through serial communication. In addition, in FIG. 2, 206 denotes a serial status transmission signal line for transmitting status data from the engine control part 202 to the controller 201 through serial communication in response to the command, and 207 denotes a serial status transmission signal line for transmitting serial data from the sheet discharging device control part 203 to the controller 201 through serial communication.

The controller 201 is a control part that controls and manages the operations of the entire color image forming apparatus.

Upon forming a color image, the controller 201 controls by transmitting serial commands to the engine control part 202 and the sheet discharging device control part 203, and receives status data from the engine control part 202 and the sheet discharging device control part 203.

In this way, the controller 201 gives commands to unitarily manages the controls and the states of each device such that one of the operations of devices consists with that of the others when a plurality of devices are connected to operate.

Upon receiving a printing operation start command from a host computer that is not shown, the controller 201 issues a printing operation start command to the engine control part 202 via the serial command transmission signal line 204. Upon receiving the printing operation start command, the engine control part 202 starts the printing operation and transmits to the controller 201 via the serial status transmission signal line 206 that it has started the printing operation.

Furthermore, after a prescribed time has passed from the printing operation start command, the controller 201 transmits a sheet discharging control command to the sheet discharging device control part 203. Upon receiving the sheet discharging control command, the sheet discharging device control part 203 starts the sheet discharging operation and transmits to the controller 201 that it has started the sheet discharging operation.

Figure 10:
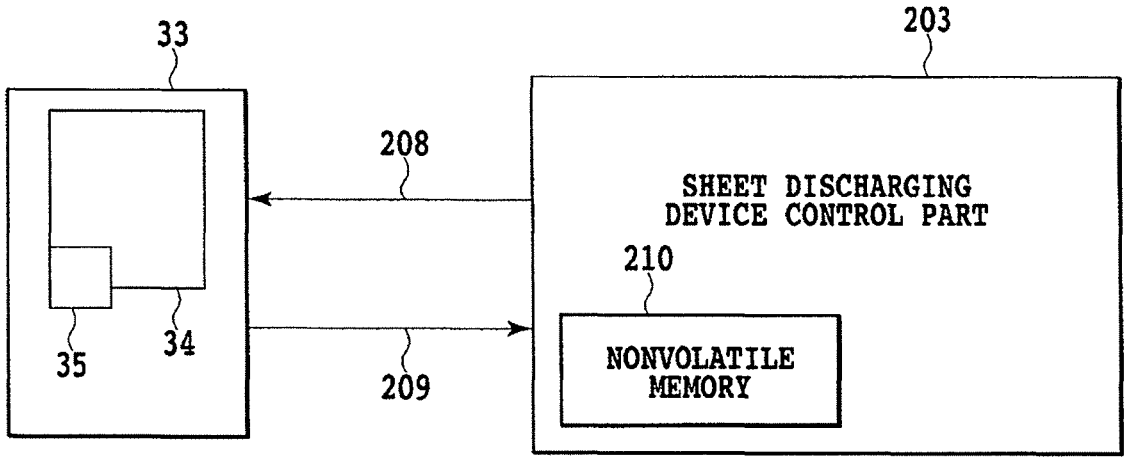
FIG. 10 illustrates relationship between the sheet discharging device control part and the staple unit.

FIG. 10 is a block diagram showing relationship between the sheet discharging device control part and the staple unit. In FIG. 10 reference numeral 203 denotes the sheet discharging device control part, 33 denotes the staple unit, 34 denotes the staple cartridge, and 35 denotes the staple detecting sensor. The staple detecting sensor 35 detects the existence of the staples. Reference numeral 210 denotes a nonvolatile memory 210 equipped by the sheet discharging device control part 203. Signal lines 208 and 209 connect the sheet discharging device control part 203 to the staple unit 33.

The image forming part shown in FIG. 1 comprises photosensitive drums (5Y, 5M, 5C, 5K), chargers (7Y, 7M, 7C, 7K), and laser scanners (10Y, 10M, 10C, 10K), and developers (8Y, 8M, 8C, 8K), which are provided for each station arranged in parallel for each developing color. Furthermore, the image forming part also includes toner cartridges (11Y, 11M, 11C, 11K), an intermediate transfer belt 12, primary transfer rollers (6Y, 6M, 6C, 6K), a secondary transfer roller 9, a sheet feeding transporting part, a fixing device 13, etc. When the printing operation is started, the photosensitive drums (5Y, 5M, 5C, 5K), which are made by applying an organic photoconductive layer on the outer periphery of aluminum cylinders, are rotated in a counterclockwise direction by a driving motor that is not shown.

The chargers (7Y, 7M, 7C, 7K) are provided with charging sleeves (7YS, 7MS, 7CS, 7KS) for achieving primary charging of the photoconductor drums.

The surfaces of the photosensitive drums (5Y, 5M, 5C, 5K) are selectively exposed to light by the laser scanners (10Y, 10M, 10C, 10K) according to the inputted image data, and electrostatic latent images are sequentially formed thereon. The developers (8Y, 8M, 8C, 8K) are provided with developing sleeves (8YS, 8MS, 8CS, 8KS) for visualizing the electrostatic latent images.

The intermediate transfer belt 12 is an endless belt that is tensioned by a drive roller 18*a* and driven rollers (18*b*, 18*c*). The intermediate transfer belt 12 rotates in a clockwise direction while abutting against the photosensitive drums (5Y, 5M, 5C, 5K), and primary transfer of toner images is carried out on the surface of the belt sequentially by the primary transfer rollers (6Y, 6M, 6C, 6K).

Recording materials 1 are stored in a sheet feeding cassette 2 or a sheet feeding tray 3 as a sheet feeding part, and the recording materials 1 are transported on a transporting path 25 that includes a sheet feeding roller 4, a transporting roller 24, and the like, thereby reaching the position of a pre-resist sensor 19. The recording materials 1 are then transported further by a fixed amount to reach a resist roller 23, thereby forming a wait loop.

The waiting recording materials 1 are re-transported, and the secondary transfer roller 9 abuts against the intermediate transfer belt 12 to transport the recording materials 1 by holding them therebetween, and thereby color visual images that are multiply transferred on the intermediate transfer belt 12 are secondary-transferred collectively. The secondary transfer roller 9 abuts against the intermediate transfer belt 12 as shown by a solid line during the secondary transfer operation. However, it is moved to a position shown by the dotted line after the secondary transfer operation.

A cleaner container 21 cleans the intermediate transfer belt 12 using a built-in cleaning blade, and stores the recovered toner that was not secondary-transferred and that remained on the intermediate transfer belt 12 as waste toner.

The fixing device 13 fixes toner images on the recording materials 1 while transporting the recording materials 1. The fixing device 13 is provided with a fixing roller 14 for heating the toner, and a pressure roller 15 for press-contacting the recording materials 1 against the fixing roller 14. The fixing roller 14 and the pressure roller 15 are hollow, and heaters 16 and 17 respectively are incorporated inside them.

The cleaner container 21 cleans the toner remaining on the photosensitive drums (5Y, 5M, 5C, 5K) and the intermediate transfer belt 12. The waste toner is stored in the cleaner container.

The sheet discharging device 29 comprises one or more sheet discharging trays 30 and 31 on which the recording materials having toner images formed thereon are sorted and loaded. The sheet discharging trays are moved vertically by a lifting motor for the sheet discharging trays, not shown, when sorting the recording materials into each sheet discharging tray. A staple unit 33 is provided with a staple processing tray 32. The staple unit 33 comprises a staple cartridge 34, and a staple detecting sensor 35. When the staple detecting sensor 35 detects that there are no staples within the staple cartridge 34, the staple detecting sensor 35 informs the controller 201 that there are no staples by sending signals through the sheet discharging device control part 203. At the same time, the signals (information) indicating that there are no staples are stored in a nonvolatile memory 210 of the sheet discharging device control part 203.

At the time of staple processing, a sheet discharging roller 36 and a drawing roller 37 are inversely rotated at the point where the rear end of the recording material transported to the sheet discharging device 29 reaches the sheet discharging roller 36 to draw and load the recording material within the staple processing tray 32. After loading two recording materials on the staple processing tray 32, the staple processing is carried out by the staple unit 33. A bundle of recording materials that are staple-processed on the staple processing tray 32 are discharged to the sheet discharging tray 30 or 31.

Figure 3:
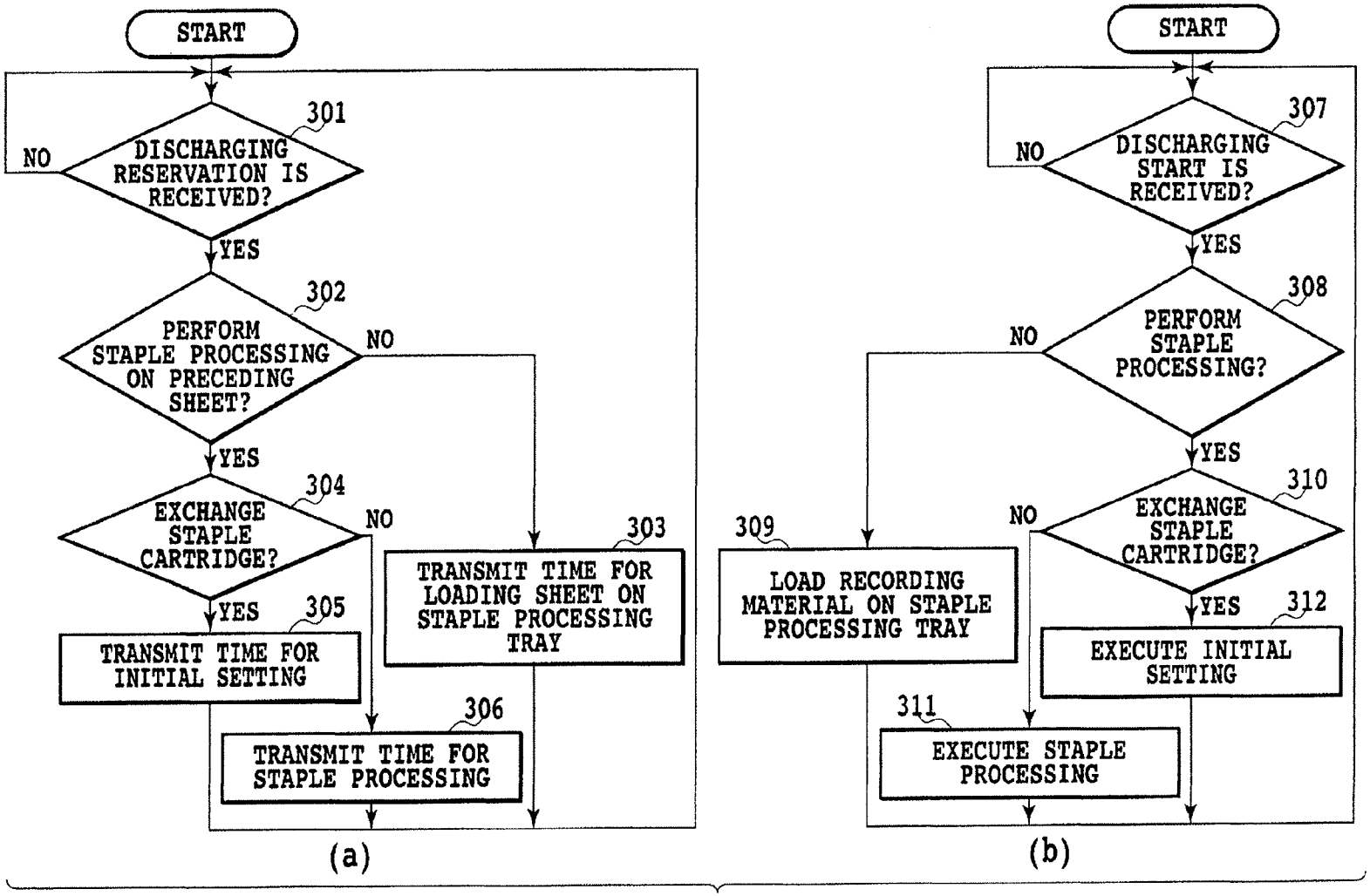
FIGS. 3(*a*) and 3(*b*) are flowcharts showing the operations of a sheet discharging device according to the first embodiment of the present invention.

FIGS. 3(*a*) and 3(*b*) are flowcharts showing the operations of the sheet discharging device control part according to this embodiment at the time of receiving a sheet discharging reservation command and a sheet discharging start command.

Referring to FIG. 3(*a*), upon receiving a sheet discharging reservation command from the controller 201 (301), the sheet discharging device control part 203 judges whether or not to perform the staple processing on the preceding sheet (302). When the preceding sheet is not subjected to the staple processing, the sheet discharging device control part 203 transmits the time necessary for loading it to the staple processing tray 32 to the controller 201 (303). When the preceding sheet is subjected to the staple processing, the sheet discharging device control part 203 judges whether or not the staple cartridge 34 has been exchanged (304). In the case where the staple detecting sensor 35 detects that there are staples and it is stored in the nonvolatile memory 210 that there are no staples, the sheet discharging device control part 203 judges that the staple cartridge 34 has been exchanged. The signals (information) indicating that there are no staples are stored in the nonvolatile memory 210. Therefore, when the power of the device is turned off, the information does not disappear and exchange of the staple cartridge 34 can be detected without fault. In addition, turning off the power of the device during the exchange of the staple cartridge 34 enhances in the case that a user puts her hands in the device. Then, the sheet discharging device control part 203 transmits the time necessary for the initial setting to the controller 201 (305). When judging that the staple cartridge 34 has not been exchanged, the sheet discharging device control part 203 transmits the time necessary for the regular staple processing to the controller 201 (306).

For example, here, the initial setting can be an operation which exposes the staple tips.

Referring to FIG. 3(*b*), when receiving the sheet discharging start command (307), the sheet discharging device control part 203 judges whether or not to perform the staple processing (308). When the staple processing is not to be carried out, the sheet discharging device control part 203 loads the transported recording materials on the staple processing tray 32 (309). When the staple processing is to be carried out, the sheet discharging device control part 203 judges whether or not the staple cartridge 34 has been exchanged (310). When the staple cartridge 34 has not been exchanged, the sheet discharging device control part 203 performs the staple processing after loading the recording materials on the staple processing tray 32 (311), and discharges a bundle of recording materials on the sheet discharging tray 30. When the staple cartridge 34 has been exchanged, the sheet discharging device 29 performs the initial setting when the recording materials are transported to the staple processing tray 32 (312). Compared to the time necessary for the regular staple processing, the initial setting requires a longer time because of the time required for performing the initial setting.

In this embodiment, the initial setting after exchanging the staple cartridge is performed by using the recording material to be stapled that has been reserved to be discharged. At that time, the sheet discharging device control part informs the controller 201 of the initial setting time, thereby the controller 201 changes the timing of transmitting the printing start command for the image forming apparatus according to that informed time.

When the initial setting is completed properly, it is stored in the nonvolatile memory that there are staples, and the bundle of stapled recording materials are discharged to the outlet tray 30.

Figure 4:
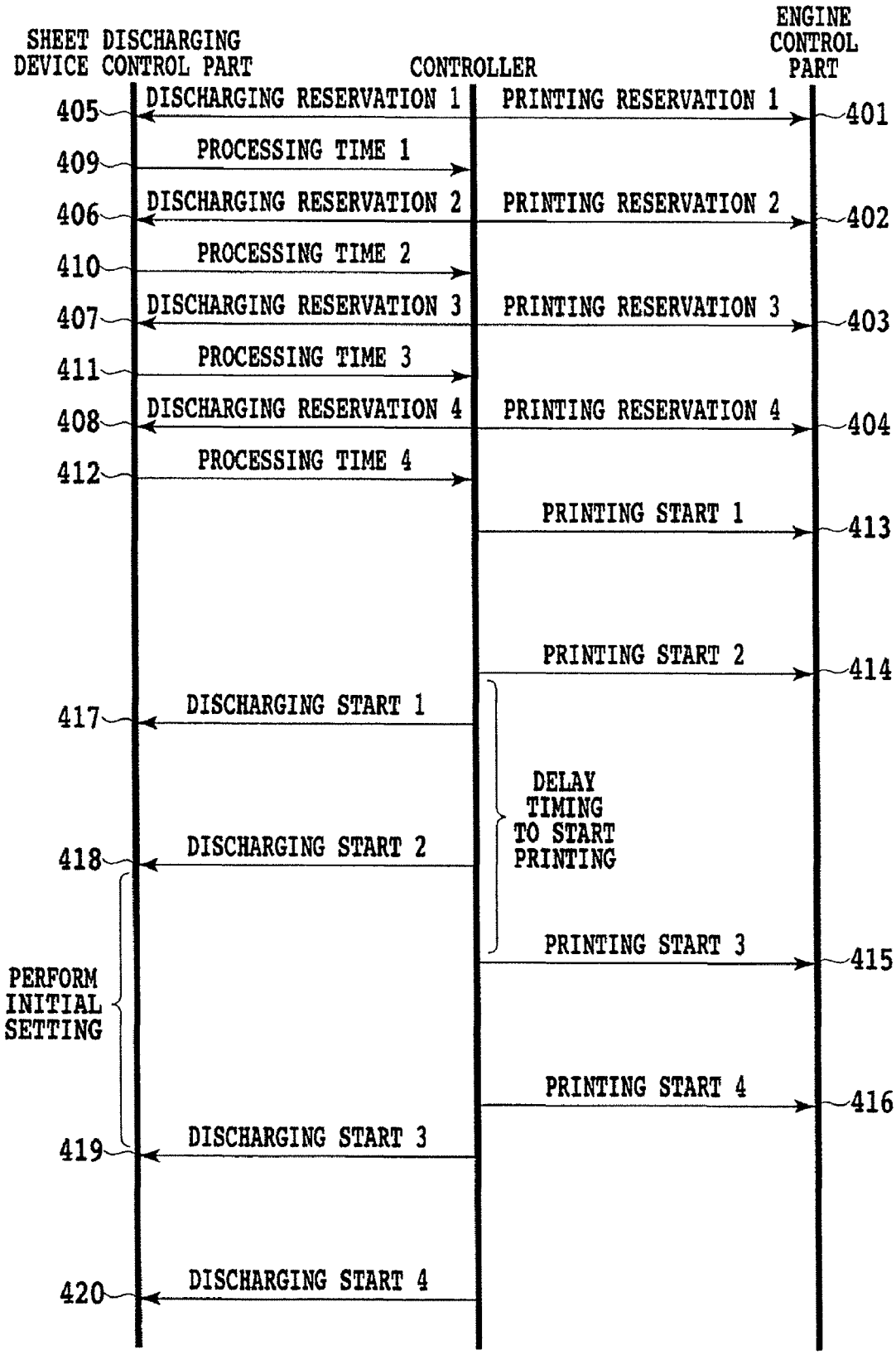
FIG. 4 is a timing chart showing the stapling/printing operation in the first embodiment of the present invention.

FIG. 4 is a timing chart according to this embodiment for showing the case where two sets of two stapled prints are made after exchanging the staple cartridge. In the timing chart shown in FIG. 4, control flows of the controller, the engine control part, and the sheet discharging device control part are shown individually, and it is assumed that transmission of information between each of the control parts is performed through serial communication shown as in FIG. 2. Furthermore, the sheet discharging device 29 performs the operation according to the flowchart shown in FIG. 3.

The controller 201 transmits 2 pieces×2 sets (=4 sheets) of printing reservation 1 (401) to printing reservation 4 (404) to the engine control part 202, and transmits sheet discharging reservation 1 (405) to sheet discharging reservation 4 (408) to the sheet discharging device control part 203. At that time, the controller 201 adds the information of the head sheet to the sheet discharging reservations 1 and 3 and then transmits, and adds the information of the last sheet (staple processing) to the sheet discharging reservations 2 and 4 and then transmits. The sheet discharging device control part 203 judges when to perform the staple processing on what page of the recording materials, based on the information of the head sheet and last sheet added to the sheet discharging reservations. Then, sheet discharging device control part 203 transmits the processing time required for each of the sheet discharging reservations to the controller 201 (409 to 412). Processing time 1 is the time necessary for the initiation operation of the sheet discharging device 29 at the time of starting the printing operation, processing time 2, 4 is the time necessary for loading the recording materials on the staple processing tray 32, and processing time 3 is the time necessary for the initial setting.

FIG. 8 specifically illustrates the printing reservation commands and the information transmitted from the sheet discharging device for the respective commands. The printing reservation commands include, by each recording material, the information indicating whether it is the head sheet of the job or the last sheet of the job and the information of the processing method carried out in the sheet discharging device.

As described above, for the processing time transmitted from the sheet discharging device, the processing time 1 is the time necessary for the initiation operation of the sheet discharging device since it is the first-page recording material of the job. The processing time 2, 4 is the time necessary for transporting the recording materials and loading those on the staple tray 32 for carrying out the staple processing. The processing time 3 is the time necessary for performing the initial setting, which include the time for carrying out the staple processing on those recording materials.

After transmitting the printing reservation and sheet discharging reservation, the controller 201 transmits printing start command 1 (413) to the engine control part 202, and the engine control part 202 starts the printing operation. When transmitting the printing start commands 2 to 4 (414 to 416), the controller 201 determines the transmission interval of the printing start commands based on the processing time 2 to 4 obtained from the sheet discharging device control part 203. In this case, the interval between the printing stat commands 2 and 3 is the processing time 3 obtained in step 411, i.e. the time necessary for the initial setting.

The sheet discharging commands 1 to 4 transmitted to the sheet discharging device control part 203 are transmitted after a prescribed time has passed from the printing start command (417 to 420). This is the time necessary for the engine control part 202 to start the printing operation and for the recording materials to reach the vicinity of the inlet of the sheet discharging device 29.

As described above, according to the embodiment it is possible to secure the time necessary for the initial setting in the regular printing operation for the staple processing after exchanging the staple cartridge. Furthermore, since the recording material for idle striking the needle is not required for the initial setting, it is possible to perform the optimum control of the image forming apparatus according to the embodiment.

Second Embodiment

Like the first embodiment, the second embodiment has the same structure in respect that the initial setting after exchanging the staple cartridge is executed by using the recording material that is to be stapled and has been reserved to be discharged. Therefore, the description thereof will be omitted.

It is assumed that this embodiment uses a sheet discharging device arranged to have a plurality of transporting paths, and there will be described a method of staple processing in that structure after exchanging the staple cartridge.

For example, if there are two transporting paths, these are called a first transporting path and a second transporting path.

Figure 5:
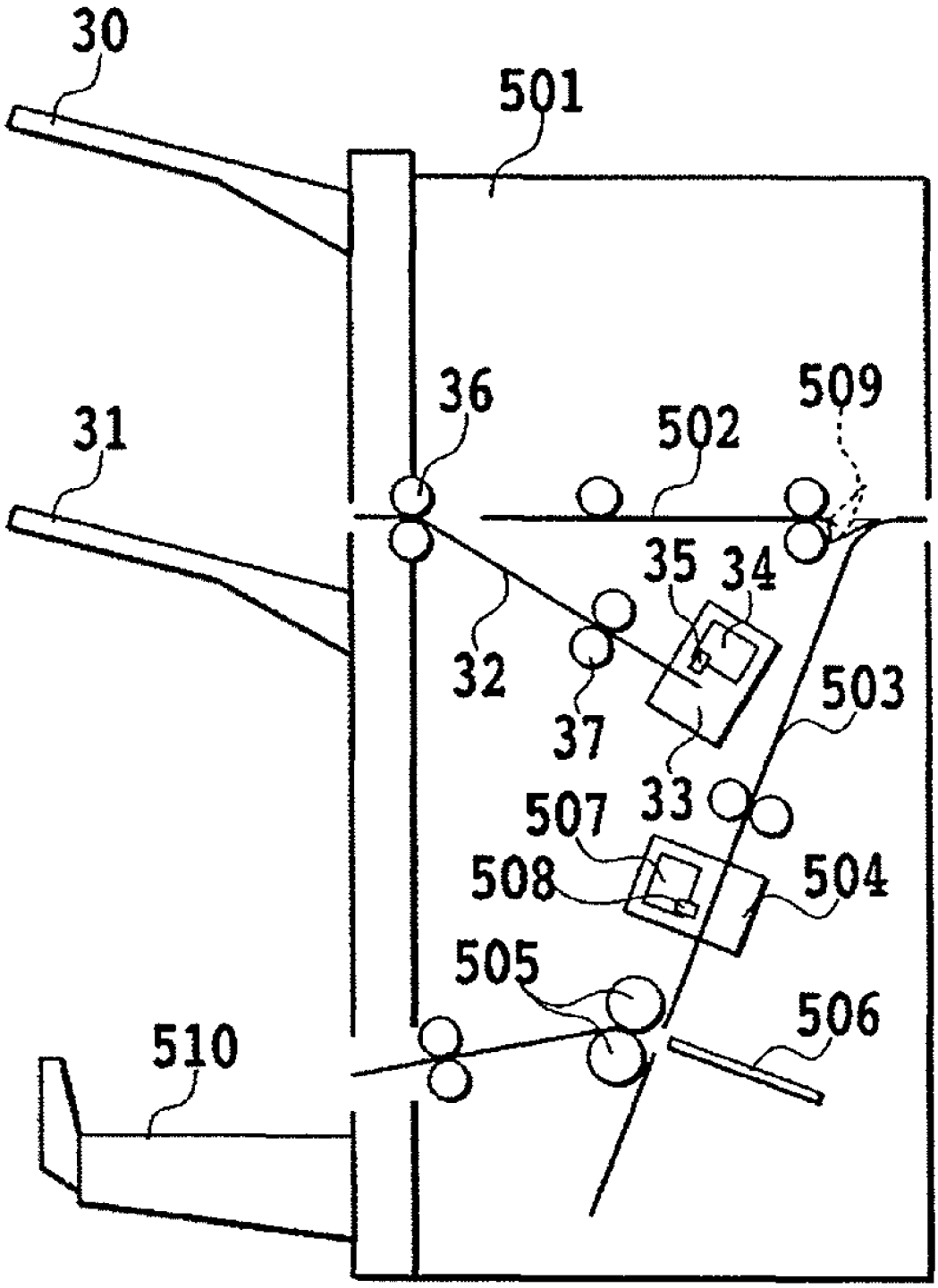
FIG. 5 is a schematic diagram of a sheet discharging device according to a second embodiment of the present invention.

FIG. 5 shows an example of the sheet discharging device arranged to have a plurality of transporting paths. In the same way as the sheet discharging device 29 of the first embodiment, a sheet discharging device 501 is mounted to an image forming apparatus 101. In the sheet discharging device 501, a transporting path 502 is a transporting path for performing the staple processing on the discharged recording materials as the case of the first embodiment. Meanwhile, a transporting path 503 is for forming a booklet by folding a bundle of recording materials into two by a folding roller 505 and an extruding plate 506, after performing staple processing at two points in the center of the bundle of the transported recording materials by a booklet staple unit 504. Then, the booklet is discharged to a booklet discharging tray 510. The booklet staple unit 504 comprises a staple cartridge 507 and a staple detecting sensor 508 like the staple unit 33. A flapper 509 provided at the inlet of the sheet discharging device is used for switching the transporting destinations of the recording materials. The flapper 509 is brought down as shown with a solid line when performing the staple processing, and the flapper 509 is brought up as shown with a dotted line when performing the booklet processing. When the initial setting is carried out in the staple unit 33, it is not possible for this kind of sheet discharging device to transport the continuously-fed recording materials to the transporting path 502. However, the recording materials can be transported to the transporting path 503. Therefore, through judging where to transport the recording materials by considering the information of the transporting path on which the recording materials are transported, the sheet discharging device 501 can effectively utilize the transporting paths, thereby the second embodiment can achieve optimum control of the image forming apparatus compared to the case of the first embodiment.

Figure 6:
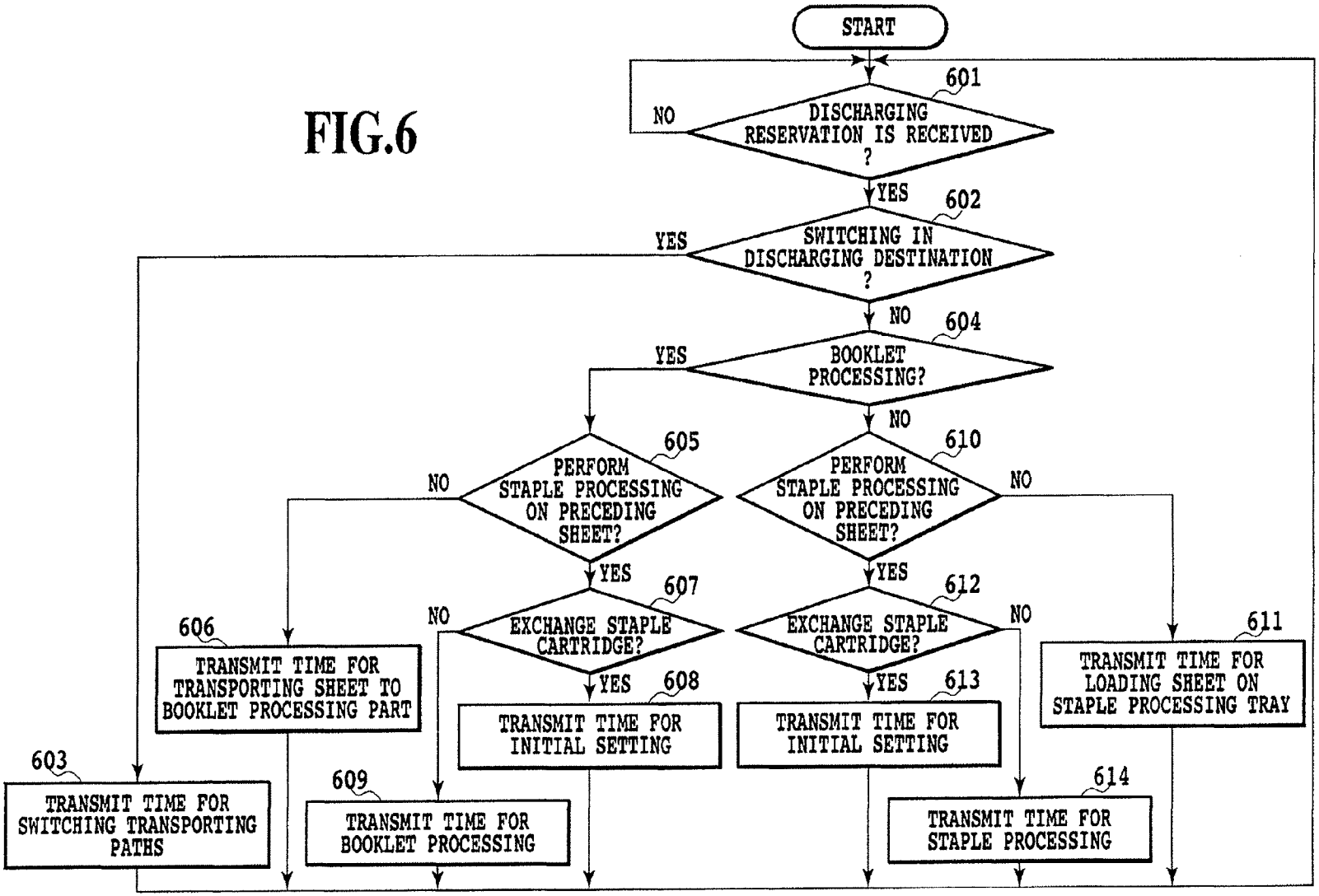
FIG. 6 is a flowchart showing the operation of the sheet discharging device according to the second embodiment of the present invention.

FIG. 6 is a flowchart showing the operation of the sheet discharging device control part 203 according to this embodiment at the time of receiving the sheet discharging command.

Upon receiving the sheet discharging reservation from the controller (601), the sheet discharging device control part 203 compares the destination of the preceding sheet and the destination of the current sheet to judge whether or not there is a switching in the destinations (602). When there is a change in the destinations, the sheet discharging device control part 203 transmits to the controller the time necessary for switching the destinations by the flapper 509 (603). When there is no switching in the destinations, it judges the destination of the current sheet (604). In the case where the destination is the transporting path 503 and the booklet processing is to be performed, it judges whether or not the preceding sheet is subjected to staple processing (605). When the staple processing is not to be performed, it transmits the time necessary for transporting the recording materials to the booklet processing part (booklet staple unit 504) (606). In the case where staple processing is to be performed, it judges whether or not the staple cartridge 507 has been exchanged (607). In the case where the staple sensor 508 detects that there are staples and it is stored in the nonvolatile memory that there are no staples, it judges that the staple cartridge 507 has been exchanged, and then, transmits to the controller 201 the time necessary for the initial setting (608). When judging that the staple cartridge 507 has not been exchanged, it transmits to the controller 201 the time necessary for the regular booklet processing (609). The processing (610 to 614) in the case where the destination is the transporting path 502 is the same as the case of the first embodiment, so the description thereof will be omitted.

Figure 7:
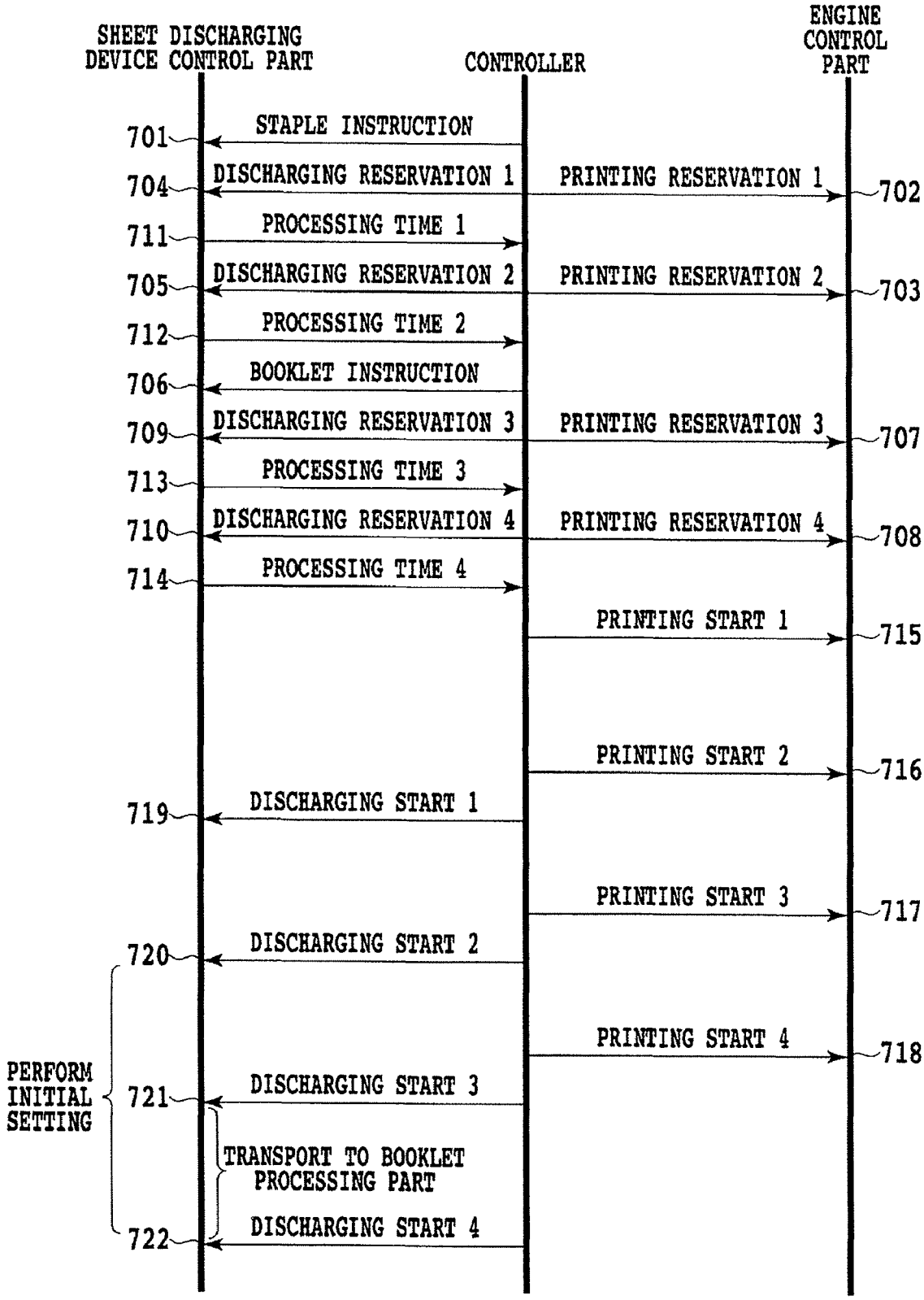
FIG. 7 is a timing chart showing the stapling/printing operation in the second embodiment of the present invention.

FIG. 7 is a timing chart showing the case where one set of two stapled sheets and one booklet of two sheets are continuously printed after exchanging the staple cartridge 34 according to the embodiment.

At first, the controller 201 transmits a transporting path designating command to the sheet discharging device control part 203 to designate the transporting path 502 (701). Then, it transmits the printing reservation command 1 (702), the printing reservation command 2 (703) to the engine control part 202, and the sheet discharging reservation command 1 (704), the sheet discharging reservation command 2 (705) to the sheet discharging device control part 203. Subsequently, the controller 201 transmits a transporting path designating command to the sheet discharging device control part 203 to designate the transporting path 503 (706). Then, it transmits the printing reservation command 3 (707), the printing reservation command 4 (708) to the engine control part 202, and the sheet discharging reservation command 3 (709), the sheet discharging reservation command 4 (710) to the sheet discharging device control part 203. At that time, the controller 201 adds the information of the head sheet to the sheet discharging reservation 1 and 3 and then transmits, and adds the information of the last sheet to the sheet discharging reservation 2 and 4 and then transmits, in the same way as the first embodiment.

According to the flowchart shown in FIG. 6, the sheet discharging device control part 203 transmits to the controller 201 the information regarding the necessary processing time for each sheet discharging reservation based on the designated processing information (time information) added to the sheet discharging reservation and the information of the head sheet and last sheet (711 to 714). Here, the processing time 1 is the time necessary for initiation operation of the sheet discharging device, and the processing time 2 is the time necessary for loading the recording materials on the staple processing tray 32. The processing time 3 is the time necessary for switching the transporting paths, and the processing time 4 is the time necessary for transporting the recording materials to the booklet processing part (booklet staple unit 504).

FIG. 9 specifically illustrates the printing reservation commands and the information transmitted from the sheet discharging device for the respective commands. The printing reservation commands include, by each recording material, the information indicating whether it is the head sheet of the job or the last sheet of the job and the information of the processing method carried out in the sheet discharging device.

As described above, for the processing time transmitted from the sheet discharging device, the processing time 1 is the time necessary for initiation operation of the sheet discharging device since it is the first-page recording material of the job. The processing time 2 is the time necessary for transporting the recording materials and loading those on the staple tray 32 for carrying out the staple processing. The processing time 3 is the time necessary for switching the transporting path to the booklet processing part side. The processing time 4 is the time necessary for transporting the recording materials to the booklet processing part.

Unlike the case of the first embodiment, the transporting paths of the recording materials corresponding to the sheet discharging reservations 3 and 4 are switched in this embodiment. Therefore, it is possible to perform the processing in the booklet processing part while performing the initial setting for the recording materials that are reserved for the sheet discharging reservation 2.

Subsequently, the controller 201 transmits the printing start command (715) to the engine control part 202, and thereby the engine control part 202 starts the printing operation. When transmitting the printing start commands 2 to 4 (716 to 718), the controller 201 determines the transmission interval of the printing start commands based on the obtained time 2 to 4. The sheet discharging commands 1 to 4 transmitted to the sheet discharging device control part 203 are transmitted (719 to 722) after a prescribed time has passed from the printing start command. This is the time necessary for the engine control part 202 to start the printing operation and for the recording materials to reach the vicinity of the inlet of the sheet discharging device 501.

For performing such printing operation, as shown in FIG. 7, the sheet discharging device control part 203 simultaneously performs the initial setting and the transporting operation of the recording materials to the booklet processing part (booklet staple unit 504) at the time of receiving the sheet discharging start command 3.

As described above, after exchanging the staple cartridge, the transporting intervals are lengthened only when the sheet discharging reservations are transmitted continuously to the same transporting path, and the regular printing time is controlled in the same processing time when the transporting paths are different. Thereby, the optimum sheet discharging control can be performed within the minimum required processing time. In this embodiment, the operation of exchanging the staple cartridge 34 has been described. However, the same processing can be performed for exchanging the staple cartridge 507. In that case, the initial setting of the booklet stapling and transporting processing of the recording materials to the transporting path 502 may be performed simultaneously.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-052152, filed Feb. 28, 2006, which is hereby incorporated by reference herein in its entirety.

What is claimed is:

1. An image forming apparatus, comprising:

an image forming part adapted to form an image on recording materials;

a post-processing device adapted to staple recording materials on which images are formed by said image forming part, wherein said post-processing device is capable of exchanging staples;

a post-processing device control part adapted to control an operation of said post-processing device; and a controller adapted to control an image forming operation of said image forming part, wherein said controller transmits a staple instruction to said post-processing device control part to execute a staple operation by said post-processing device, wherein, when said controller transmits the staple instruction to said post-processing control part and the staples of said post-processing device have been exchanged, said post-processing device control part controls said post-processing device to execute an idle striking operation which exposes tips of the staples to be used for the recording materials for which the staple operation is instructed by the staple instruction and on which images are formed without using new recording material for the idle striking operation, wherein said post-processing device control part transmits the information about time including a time to execute the idle striking operation to said controller, and wherein said controller controls the image forming operation in accordance with the information about time, including the time to execute the idle striking operation.

2. The image forming apparatus according to claim 1, wherein said controller changes a start timing of the image forming operation in accordance with the information.

3. The image forming apparatus according to claim 2, wherein said controller changes the start timing based on the information to be later than the start timing of image forming in a case where staples are not exchanged.

4. The image forming apparatus according to claim 1, wherein said controller transmits information about reservation of the staple operation to said post-processing device control part, and wherein said post-processing control part transmits the information about time including time to execute the idle striking operation to said controller in accordance with the information about reservation of the staple operation.

5. The image forming apparatus according to claim 1, wherein said image forming part comprises:

a photosensitive drum;

a developing member for developing an electrostatic latent image on a surface of said photosensitive drum;

a transfer member for transferring an image developed on the surface of said photosensitive drum to the recording materials; and a fixing member for fixing images on the surface of the recording materials.

6. The image forming apparatus according to claim 1, wherein exchange of the staples is detected based on whether a staple cartridge is mounted or not.

7. The image forming apparatus according to claim 1, wherein said post-processing device comprises a first transporting path and a second transporting path, and a first stapler is disposed in said first transporting path and a second stapler is disposed in said second transporting path, wherein when staples of said first stapler have been exchanged, said post-processing device control part controls said post-processing device to execute the idle striking operation for recording materials for which stapling is instructed by the staple instruction and on which images are formed, by transporting the recording materials to said first transporting path and using said first stapler, and to transport next recording materials for which stapling has been instructed to said second transporting path.

8. A post-processing device for use coupled to an image forming apparatus, comprising:

a staple device adapted to staple recording materials on which an image is formed by the image forming apparatus, wherein said staple device is capable of exchanging staples; and a post-processing device control part adapted to control an operation of said post-processing device according to a staple instruction received from the image forming apparatus, wherein, when said post-processing device receives the staple instruction from the image forming apparatus and staples of said staple device have been exchanged, said post-processing device control part controls said staple device to execute an idle striking operation which exposes tips of the staples to be used for recording materials for which the staple operation is instructed by the staple instruction and on which images are formed without using a new recording material for the idle striking operation, wherein said post-processing device control part transmits the information about time including a time to execute the idle striking operation to the image forming apparatus, and wherein the information about time, including the time to execute the idle striking operation, is used by a controller of the image forming apparatus to control an image forming operation.

9. The post-processing device according to claim 8, wherein said staple device is capable of exchanging a staple cartridge that houses staples, and exchange of the staples is detected based on whether the staple cartridge is mounted or not.

10. The post-processing device according to claim 8, further comprising:

a first transporting path and a second transporting path;

a first stapler disposed in said first transporting path; and a second stapler disposed in said second transporting path, wherein when staples of said first stapler has been exchanged, said post-processing device control part controls said staple device to execute the idle striking operation for the recording materials for which stapling is instructed by the staple instruction and on which images are formed, by transporting the recording materials to said first transporting path and using said first stapler, and to transport next recording materials for which stapling has been instructed to said second transporting path.

11. The post-processing device according to claim 8, further comprising a memory means for memorizing information, and a staple detecting part for detecting the existence of staples, wherein said memory means memorizes the information indicating that there are no staples if said staple detecting part detects that there are no staples.

12. A method of controlling a post-processing device having a stapler for stapling recording materials, the method comprising:

receiving a staple instruction to staple the recording materials;

controlling the post-processing device to execute, when the post-processing device receives the staple instruction and the staples of the post-processing device have been exchanged, an idle striking operation which exposes tips of the staples to be used for recording materials for which the staple operation is instructed by the staple instruction and on which images are formed without using a new recording material for the idle striking operation; and outputting a signal, including a time to execute the idle striking operation, so as to control an operation of an image forming apparatus.

13. The method according to claim 12, wherein the post-processing device staples recording materials on which images are formed by the image forming apparatus.

14. The post-processing device according to claim 8, wherein the information is used by a controller of the image forming apparatus so as to instruct the post-processing device to perform an operation.

15. The method according to claim 12, wherein the signal includes information about time to execute the idle striking operation.

* * * * *